US005372103A

United States Patent [19]

Hackett et al.

[11] Patent Number: 5,372,103

[45] Date of Patent: Dec. 13, 1994

[54] METHOD OF MOUNTING A CERAMIC VALVE GUIDE ASSEMBLY

[75] Inventors: David E. Hackett, Washington; Michael H. Haselkorn, Peoria, both of Ill.

[73] Assignee: Caterpillar Inc., Peoria, Ill.

[21] Appl. No.: 232,922

[22] Filed: Apr. 25, 1994

[51] Int. Cl.[5] ..... F01L 3/02

[52] U.S. Cl. ..... 123/188.3; 123/188.9; 29/888.41

[58] Field of Search ..... 123/188.2, 188.3, 188.9; 29/888.41

[56] References Cited

U.S. PATENT DOCUMENTS

| | | | |
|---|---|---|---|
| 4,359,022 | 11/1982 | Nakamura et al. | 123/188.3 |
| 4,598,675 | 7/1986 | Long | 123/90.51 |
| 4,676,074 | 6/1987 | Narita et al. | 29/888.41 |
| 4,688,527 | 8/1987 | Mott et al. | 123/188 AA |
| 4,716,869 | 1/1988 | Dworak et al. | 123/188.9 |
| 4,798,181 | 1/1989 | Beer et al. | 29/888.41 |

FOREIGN PATENT DOCUMENTS 4-134109 5/1992 Japan .

*Primary Examiner*—E. Rollins Cross
*Assistant Examiner*—Erick Solis
*Attorney, Agent, or Firm*—Diana L. Charlton

[57] ABSTRACT

In order to achieve great engine efficiency, heat, normally dissipated through the cooling system, is directed through the exhaust passage to increase the turbocharger output. Conventional iron base valve guides cannot operate effectively within the high temperature ranges. Therefore, ceramic valve guides capable of withstanding high temperature ranges are being used for increased engine durability. Unfortunately, ceramic valve guides are difficult to install into a cylinder head using any currently available techniques. The present invention provides a simple means for mounting a ceramic valve guide assembly (52) within a cylinder head (18). A ceramic sleeve (70) is inserted into a metallic sleeve (80). The ceramic sleeve (70) and the metallic sleeve (80) are machined so that an interference fit is obtained when assembled to define the valve guide assembly (52). The valve guide assembly (52) is installed into the cylinder head (18) in a normal manner. Proper selection of the dimensions and materials for the ceramic sleeve (70) and the metallic sleeve (80) will result in a design wherein the stresses and contact pressures of the ceramic sleeve (70), the metallic sleeve (80), and the cylinder head (18) are each kept reasonable at all conditions encountered during manufacturing, assembly, and operation of the engine.

16 Claims, 1 Drawing Sheet

METHOD OF MOUNTING A CERAMIC VALVE GUIDE ASSEMBLY

TECHNICAL FIELD

This invention relates generally to a ceramic valve guide assembly and more particularly to mounting the ceramic valve guide assembly in a cylinder head of an internal combustion engine.

BACKGROUND ART

Present internal combustion engines are being manufactured for increased efficiency and greater horsepower outputs. In order to achieve greater efficiency, exhaust temperatures are increased as less heat is transferred to the cooling system. The increased exhaust temperatures increase the output of any exhaust energy recovery hardware, such as the turbocharger, and subsequently, the performance of the engine. Typically, current engine valve guides are made from an iron base material which operate within a limited maximum temperature range. Consequently, the iron base valve guides are not conducive for operating within the high exhaust temperature ranges reached with high efficiency engines. In order to utilize a valve guide within high exhaust temperatures, alternative materials must be used. One proposed solution to the above problem is to use a ceramic material for the valve guide. Ceramics typically have much higher temperature capabilities than the current iron based material.

An example of a valve guide composed of a ceramic material is disclosed in U.S. Pat. No. 4,688,527 issued to Donald H. Mort et. al. on Aug. 25, 1987. This prior art design for inclusion with a cast metal cylinder head includes a ceramic valve seating and stem supporting integral device for supporting and sealingly interacting with a conventional engine poppet-type valve. The device is integrally cast together to form a unit for subsequent inclusion within the metal cylinder head of the internal combustion engine by casting. However, casting ceramic components within a cylinder head can be an expensive endeavor. The shrinking of the cast metal during the casting cooling process has a strong potential for over stressing the ceramic insert and causing it to crack. Moreover, the resultant interference fit achieved through conventional shrink fitting the ceramic valve guide into the cylinder head will be lost once the engine is at operating temperatures due to the differential thermal expansion between the ceramic and the cylinder head material. Exotic, precise, and costly controls must be maintained during the casting process to avoid this concern. Additionally, such a cast-in ceramic insert does not allow the replacement of either the valve guide or the valve seat. This renders the cylinder head unsuitable for rebuilding in the event of either a component failure or time related wear-out.

The present invention is directed to overcoming the problems as set forth above.

DISCLOSURE OF THE INVENTION

In one aspect of the present invention, a method of mounting a valve guide assembly into a cylinder head of an internal combustion engine is disclosed. The mounting method includes forming the outer surface of a ceramic sleeve composed of a material having a low coefficient of expansion to a predetermined size. Then, forming the inner surface of a sleeve composed of a material having a high coefficient of expansion to a predetermined size less than the predetermined size of the outer surface of the ceramic sleeve so that an interference fit may be created between the sleeves. Next, inserting the ceramic sleeve into the high coefficient of expansion sleeve to define a valve guide assembly. Then, machining the outer surface of the valve guide assembly coaxially with the inner surface of the valve guide assembly so that a predetermined size is established. Finally, fitting the valve guide assembly into the cylinder head.

In another aspect of the present invention, a valve guide assembly includes a first sleeve and a second sleeve. The first sleeve has an inner surface and an outer surface and is composed of a ceramic material having a low coefficient of expansion. The second sleeve has an inner surface and an outer surface and is composed of a material having a high coefficient of expansion. The second sleeve circumferentially surrounds the first sleeve to define an interference fit. The outer surface of the second sleeve being coaxial with the inner surface of the first sleeve.

The present invention, through the use of a ceramic valve guide assembly which is simple, easily assembled, and economically mounted within an internal combustion engine provides a means for withstanding high exhaust temperatures for greater engine efficiency and durability.

BEST MODE FOR CARRYING OUT THE INVENTION

Figure 1:
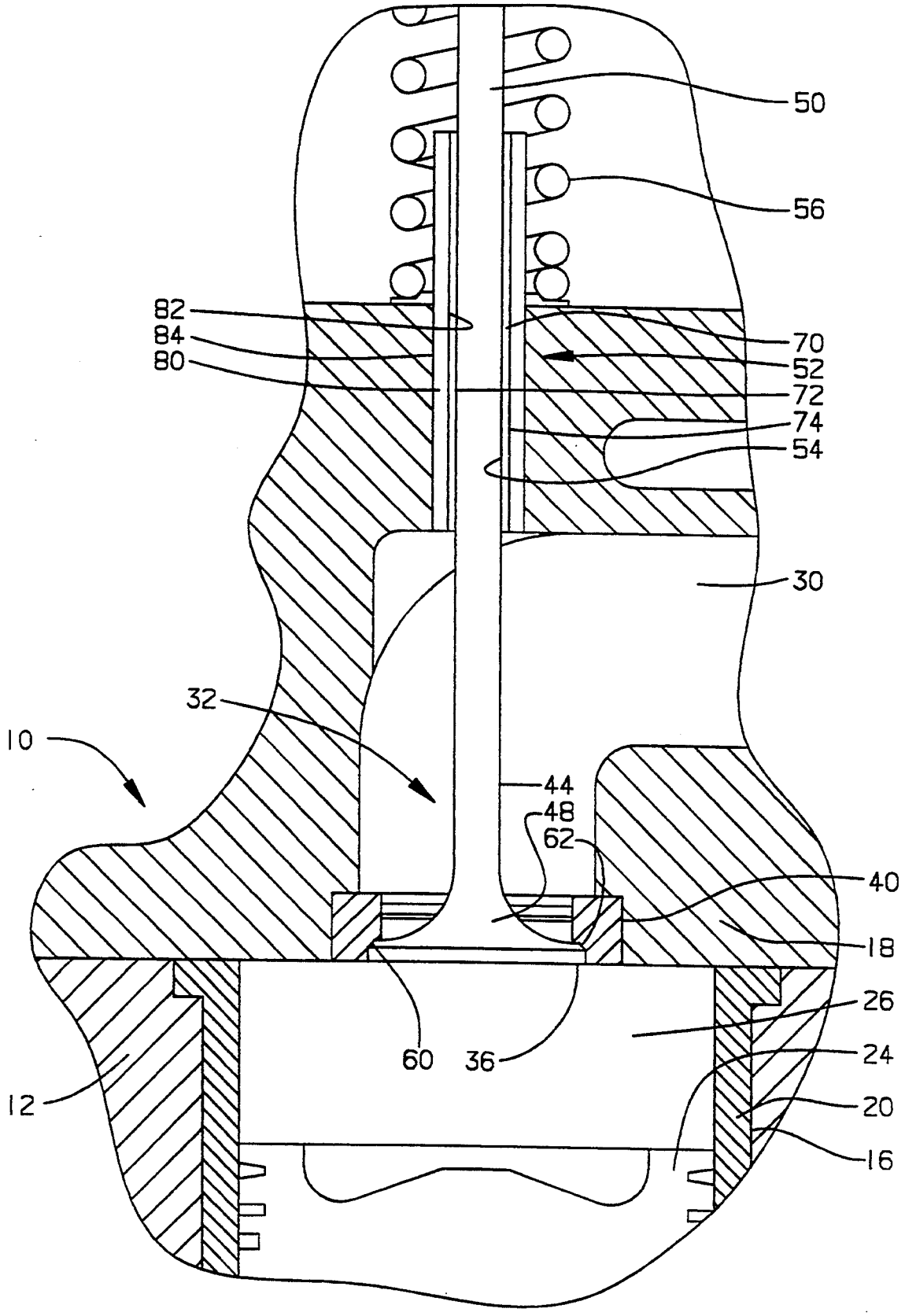
FIG. 1 is a partial section view of a combustion chamber for an internal combustion engine embodying the present invention.

A partial view of an internal combustion engine 10 including a cylinder block 12 defining a cylinder bore 16 is shown in FIG. 1. A cylinder head 18 is releasably mounted at the upper end of the cylinder block 12 in a conventional manner. A cylinder liner 20 is disposed within the cylinder bore 16. A piston 24 reciprocates in the cylinder liner 20 and cooperates with the cylinder head 18 to define a combustion chamber 26. Only a single cylinder has been illustrated and will be described. It should be understood, however, that the invention is capable of use in engines having multiple cylinders and various cylinder configurations.

An exhaust passage 30 is formed within the cylinder head 18 and is used for expelling gases out of the combustion chamber 26. A valving arrangement 32 is operatively associated and fluidly connected with the combustion chamber 26 through an opening 36 encircled by an annular valve seat member 40. The valving arrangement 32 consists of a poppet-type valve 44 commonly used in internal combustion engines. The valve 44 includes an enlarged head portion 48 which is connected to an elongated cylindrical stem portion 50. The stem portion 50 is supported within a valve guide assembly 52 which is mounted into the cylinder head 18. An interior bore 54 in the guide assembly 52 is sized to a predetermined dimension to closely encircle the stem portion 50 so that movement of the valve 44 is directed in a direct linear path. The movement of the valve 44 within the guide assembly 52 causes the enlarged head portion 48 to move toward and away from the piston 24 defining an open and closed position of the valve 44, respectively. The valve 44 is shown in the closed position in FIG. 1. The valve 44 is urged to the open position in any suitable manner, such as by a mechanical, hydraulic, or electronic control means. A coil spring, similar to the one shown at 56, encircles the stem portion 50 and acts against a keeper (not shown) for urging the valve 44 to the closed position. The head portion 48 includes an accurately ground inclined surface 60 thereabout which seats on a valve seat surface 62 in the valve seat member 40 when the valve 44 is in the closed position. Gases are expelled from the combustion chamber 26 and into the passage 30 when the valve 44 is in the open position as is well known in engine operation. It should be understood that although only an exhaust valve arrangement is described, the present invention may be used on an intake valve arrangement.

The valve guide assembly 52 includes a ceramic sleeve 70 which has an inner surface 72 and an outer surface 74. The ceramic sleeve 70 is composed of a material, such as silicon nitride, boron carbide, or any suitable material which has a low coefficient of expansion, generally within the range of 2.5E-6 to 10.8E-6 mm/mm/C.°. The ceramic sleeve 70 has a predetermined thickness of 1 mm. However, the relative thickness of the ceramic sleeve is a function of the ceramic component size and associated coefficient of expansion and may differ from that given. A metallic sleeve 80 is securely fitted around the ceramic sleeve 70 in any suitable manner, such as press-fitting or shrink-fitting, to circumferentially surround the ceramic sleeve 70. The metallic sleeve 80 has an inner surface 82 and an outer surface 84. The metallic sleeve 80 is composed of a material, such as steel, aluminum, or any other suitable material, which has a high coefficient of expansion, generally within the range of 14.9E-6 to 25.0E-6 mm/mm/C.°.The metallic sleeve 80 has a predetermined thickness of 2 mm. However, the thickness of the metallic sleeve 80 is related to the ceramic material used and may differ from that given. Generally the metallic sleeve thickness is generally greater than the thickness of the ceramic sleeve 70 in order to achieve the desired results. The outer surface 84 of the metallic sleeve 80 is machined coaxially with the inner surface 72 of the ceramic sleeve 70. It should be understood that the above description generally applies to this invention as it is applied to a cylinder made from cast iron. Similar solutions can be applied to a cylinder head made from other materials, such as aluminum.

INDUSTRIAL APPLICABILITY

In order to mount the valve guide assembly 52 within the cylinder head 18, several steps must take place to ensure that the ceramic sleeve 70 does not crack or fail during the assembly process. The outer surface 74 of the ceramic sleeve 70 must be machined to a predetermined size. The inner surface 82 of the metallic sleeve 80 is machined to a predetermined size less than the predetermined size of the outer surface 74 of the ceramic sleeve 70. This ensures that an interference fit may be created when the ceramic sleeve 70 is inserted into the metallic sleeve 80. The metallic sleeve 80 may be heated and/or the ceramic sleeve 70 may be chilled before insertion to ease the assembly. A press-fit may also be used to assemble the ceramic sleeve 70 and the metallic sleeve 80. The press-fit may be accomplished by machining the ceramic sleeve 70 and the metallic sleeve 80 into frustoconical shapes which are dimensioned such that an interference fit is obtained between the sleeves 70, 80 during assembly. The ceramic sleeve 70 is inserted into the metallic sleeve 80 until the sleeves 70, 80 are in contact with each other. The ceramic sleeve 70 is then pressed into the metallic sleeve by either a specified distance or applied axial load in order to achieve the desired compressive stress. To maximize the effectiveness of the metallic sleeve 80 during assembly, the interference fit created between the metallic sleeve 80 and the ceramic sleeve 70 should allow the metallic sleeve to reach its yield point. This is achieved through various size, shape, and thickness determinations dependent upon the material used for the sleeves 70, 80. The metallic sleeve 80, at its yield point, compresses the ceramic sleeve 70 so that high compressive stresses are developed in the ceramic sleeve 70. Once the first sleeve 70 is inserted into the second sleeve 80, the outer surface 84 of the second sleeve 80 is machined coaxially with the inner surface 72 of the first sleeve 70 to define a ceramic valve guide assembly 52.

The ceramic valve guide assembly 52 is shrink-fitted into the cylinder head 18 in a conventional manner. Shrink-fitting the valve guide assembly 52 includes chilling the valve guide assembly 52 typically to approximately −80 C.°. Care must be exercised during the selection of the interference fit between the ceramic sleeve 70 and the metallic sleeve 80. The chilling of the valve guide assembly 52 results in increased interference between these two components due to the differential in the thermal coefficients of expansion causing the metallic sleeve 80 to exert an additional compressive force upon the ceramic sleeve 70. Therefore, the stress state in the ceramic sleeve 70 must not exceed its strength capability in the chilled state. The cylinder head 18 may be heated before inserting the valve guide assembly 52 to increase the ease of assembly. The high stress state of the ceramic sleeve 70 enables the ceramic sleeve to withstand loads during engine 10 operation as is well known in the use of ceramics.

In view of the above, the ability to mount a ceramic material capable of withstanding high exhaust temperatures simply and economically within a valve guide assembly provides a means for achieving greater engine efficiency and durability. This is accomplished by mounting a ceramic valve guide, having a low coefficient of expansion, in a cylinder head, having a moderate coefficient of expansion, by introducing an intermediate material having a high coefficient of expansion. The materials and dimensions of the ceramic and intermediate material components being specifically selected to achieve a valve guide assembly which will maintain an interference fit with the cylinder head at all operating temperatures.

We claim:

1. A method of mounting a valve guide assembly (52) into a cylinder head (18) of an internal combustion engine (10), comprising the steps of:

forming the outer surface (74) of a sleeve (70) composed of a ceramic material having a low coefficient of expansion to a predetermined size;

forming the inner surface (82) of a sleeve (80) composed of a material having a high coefficient of expansion to a predetermined size less than the predetermined size of the outer surface (74) of the ceramic sleeve (70) so that an interference fit may be created between the sleeves (70, 80);

inserting the ceramic sleeve (70) into the high coefficient of expansion sleeve (80) to define a valve guide assembly (52);

machining the outer surface (84) of the valve guide assembly (52) coaxially with the inner surface (84) of the valve guide assembly (52) so that a predetermined size is established; and fitting the valve guide assembly (52) into the cylinder head (18).

2. The method of mounting the valve guide assembly (52) of claim 1, wherein the step of forming the inner surface (82) of a sleeve (80) composed of a material having a high coefficient of expansion to a predetermined size less than the predetermined size of the outer surface (74) of the ceramic sleeve (70) so that an interference fit may be created between the sleeves (70, 80) includes the step of:

providing an interference fit which forces the sleeve (80) having a high coefficient of expansion to the yield point of the material.

3. The method of mounting the valve guide assembly (52) of claim 2, wherein the step of forming the outer surface (74) of a sleeve (70) composed of a ceramic material includes the step of:

machining the outer surface.

4. The method of mounting the valve guide assembly (52) of claim 3, wherein the step of forming the inner surface (74) of a sleeve (70) composed of a material having a high coefficient of expansion includes the step of:

machining the inner surface.

5. The method of mounting the valve guide assembly (52) of claim 4, including the steps of:

utilizing a metallic material for the high coefficient of expansion sleeve (80); and heating the metallic sleeve (80) before inserting the ceramic sleeve (70).

6. The method of mounting the valve guide assembly (52) of claim 4, including the steps of:

utilizing a metallic material for the high coefficient of expansion sleeve (80); and cooling the ceramic sleeve (70) before inserting the ceramic sleeve (70).

7. The method of mounting the valve guide assembly (52) of claim 4, including the steps of:

utilizing a metallic material for the nigh coefficient of expansion sleeve (80); and heating the metallic sleeve (80) and cooling the ceramic sleeve (70) before inserting the ceramic sleeve (70).

8. The method of mounting the valve guide assembly (52) of claim 4, including the steps of:

utilizing a metallic material for the high coefficient of expansion sleeve (80);

machining the ceramic sleeve (70) and the metallic sleeve (80) in a frusto-conical shape;

inserting the ceramic sleeve (70) until contact is made with the metallic sleeve (80); and pressing the ceramic sleeve (70) a specified distance into the metallic sleeve (80).

9. The method of mounting the valve guide assembly (52) of claim 4, including the steps of:

utilizing a metallic material for the high coefficient of expansion sleeve (80);

machining the ceramic sleeve (70) and the metallic sleeve (80) in a frusto-conical shape;

inserting the ceramic sleeve (70) until contact is made with the metallic sleeve (80); and pressing the ceramic sleeve (70) into the metallic sleeve (80) with a specified axial load.

10. A valve guide assembly (52), comprising:

a first sleeve (70) having an inner surface (72) and an outer surface (74) and being composed of a ceramic material having a low coefficient of expansion; and a second sleeve (80) having an inner surface (82) and an outer surface (84) and being composed of a material having a high coefficient of expansion, the second sleeve (80) circumferentially surrounding the first sleeve (70) to define an interference fit and the outer surface (84) of the second sleeve (80) being coaxial with the inner surface (72) of the first sleeve (70).

11. The valve guide assembly (52) of claim 10, wherein the second sleeve (80) is composed of a metallic material.

12. The valve guide assembly (52) of claim 11, wherein the interference fit forces the second sleeve (80) to the yield point of the material.

13. The valve guide assembly (52) of claim 11, wherein the first sleeve (70) is shrink fitted into the second sleeve (80).

14. The valve guide assembly (52) of claim 11, wherein the first sleeve (70) is press fitted into the second sleeve (80).

15. The valve guide assembly (52) of claim 11, wherein the second sleeve (80) is composed of steel.

16. The valve guide assembly (52) of claim 14, wherein the first sleeve (70) and the second sleeve (80) each have a frusto-conical shape.

* * * * *

UNITED STATES PATENT AND TRADEMARK OFFICE
CERTIFICATE OF CORRECTION

| | | |
|---|---|---|
| **PATENT NO.** | : | **5,372,103** |
| **DATED** | : | **December 13, 1994** |
| **INVENTOR(S)** | : | **David E. Hackett et al.** |

It is certified that error appears in the above-identified patent and that said Letters Patent is hereby corrected as shown below:

Column 1, line 5, in a separate paragraph after the title, "METHOD OF MOUNTING A CERAMIC VALVE GUIDE ASSEMBLY", forming a new paragraph insert, --This invention was made with Government support under Contract No. DE-FC02-92CE-41002 awarded by the Department of Energy. The Government has certain rights in this invention.--.

Signed and Sealed this

Thirty-first Day of October, 2000

*Attest:*

Q. TODD DICKINSON

*Attesting Officer*

*Director of Patents and Trademarks*